US007482527B2

(12) United States Patent
Huang et al.

(10) Patent No.: US 7,482,527 B2
(45) Date of Patent: Jan. 27, 2009

(54) METHOD OF UTILIZING A TOUCH SENSOR FOR CONTROLLING MUSIC PLAYBACK AND RELATED MUSIC PLAYBACK DEVICE

(75) Inventors: Yen-Ju Huang, Taipei Hsien (TW); Wei-Nan William Tseng, Taipei (TW); Cheng-Te Tseng, Taipei (TW); Hung-Yi Chen, Hsin-Chu (TW)

(73) Assignees: Benq Corporation, Neihu Dist., Taipei (TW); Qisda Corporation, Shang-Ting Tsun, Gueishan Hsiang, Taoyuan County (TW)

( * ) Notice: Subject to any disclaimer, the term of this patent is extended or adjusted under 35 U.S.C. 154(b) by 43 days.

(21) Appl. No.: 11/422,333

(22) Filed: Jun. 6, 2006

(65) Prior Publication Data

US 2007/0289433 A1 Dec. 20, 2007

(51) Int. Cl.
*G10H 7/04* (2006.01)
*G10H 1/34* (2006.01)

(52) U.S. Cl. ..... 84/605; 84/745

(58) Field of Classification Search ..... 84/603, 84/605, 612, 636, 645, 652, 668, 714, 720, 84/745; 345/173, 174

See application file for complete search history.

(56) References Cited

U.S. PATENT DOCUMENTS 6,687,193 B2 * 2/2004 Jung ..... 369/4
2004/0177746 A1 * 9/2004 Becker ..... 84/612

OTHER PUBLICATIONS

KORK Kaoss Pad KP2 Owner's Manual. 2002.*

* cited by examiner

*Primary Examiner*—Walter Benson
*Assistant Examiner*—Andrew R Millikin
(74) *Attorney, Agent, or Firm*—Winston Hsu

(57) ABSTRACT

A method of controlling music playback includes providing a sensor array comprising first sensors arranged adjacent to one another, receiving data output from first sensors of the sensor array, the data including activation times during which each of the first sensors was activated, comparing the activation times of each first sensor to determine if the first sensors were sequentially activated along a first direction or a second direction opposite to the first direction, controlling the music to be played in a forward direction if the first sensors were sequentially activated along the first direction, and controlling the music to be played in a backward direction if the first sensors were sequentially activated along the second direction.

22 Claims, 7 Drawing Sheets

METHOD OF UTILIZING A TOUCH SENSOR FOR CONTROLLING MUSIC PLAYBACK AND RELATED MUSIC PLAYBACK DEVICE

BACKGROUND OF THE INVENTION

1. Field of the Invention

The present invention relates to a music playback device, and more specifically, to a touch sensor used for controlling direction, speed, and key of music playback on the music playback device.

2. Description of the Prior Art

Music is an important part of the lives of many. Recent technology advances have led to the introduction of numerous kinds of portable music players. People now have more control over what music they listen to, when and where they listen to it, and how they listen to it. With the variety of portable music players now on the market, new ways to control music playback are needed for offering users new ways to enjoy their music.

SUMMARY OF THE INVENTION

It is therefore an objective of the claimed invention to provide a music playing device and related method of controlling music playback. According to an embodiment of the claimed invention, a method of controlling music playback includes providing a sensor array comprising first sensors arranged adjacent to one another, receiving data output from first sensors of the sensor array, the data including activation times during which each of the first sensors was activated, comparing the activation times of each first sensor to determine if the first sensors were sequentially activated along a first direction or a second direction opposite to the first direction, controlling the music to be played in a forward direction if the first sensors were sequentially activated along the first direction, and controlling the music to be played in a backward direction if the first sensors were sequentially activated along the second direction.

According to another embodiment of the claimed invention, a method of controlling music playback includes providing a sensor array comprising first sensors arranged adjacent to one another, receiving data output from first sensors of the sensor array, the data including activation times during which each of the first sensors was activated, comparing the activation times of each first sensor to determine if the first sensors were sequentially activated along a first direction or a second direction opposite to the first direction, raising a key of the music if the first sensors were sequentially activated along the first direction, and lowering the key of the music if the first sensors were sequentially activated along the second direction.

According to yet another embodiment of the claimed invention, a music playing device includes a sensor array comprising first sensors arranged adjacent to one another, a sensor handling circuit for receiving data output from first sensors of the sensor array, the data including activation times during which each of the first sensors was activated, for comparing the activation times of each first sensor to determine if the first sensors were sequentially activated along a first direction or a second direction opposite to the first direction, and for outputting music control signals, and an audio output circuit for receiving the music control signals from the sensor handling circuit, for controlling the music to be played in a forward direction if the first sensors were sequentially activated along the first direction, and for controlling the music to be played in a backward direction if the first sensors were sequentially activated along the second direction.

According to still another embodiment of the claimed invention, a music playing device, includes a sensor array comprising first sensors arranged adjacent to one another, a sensor handling circuit for receiving data output from first sensors of the sensor array, the data including activation times during which each of the first sensors was activated, for comparing the activation times of each first sensor to determine if the first sensors were sequentially activated along a first direction or a second direction opposite to the first direction, and for outputting music control signals, and an audio output circuit for receiving the music control signals from the sensor handling unit, for raising a key of the music if the first sensors were sequentially activated along the first direction, and for lowering the key of the music if the first sensors were sequentially activated along the second direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
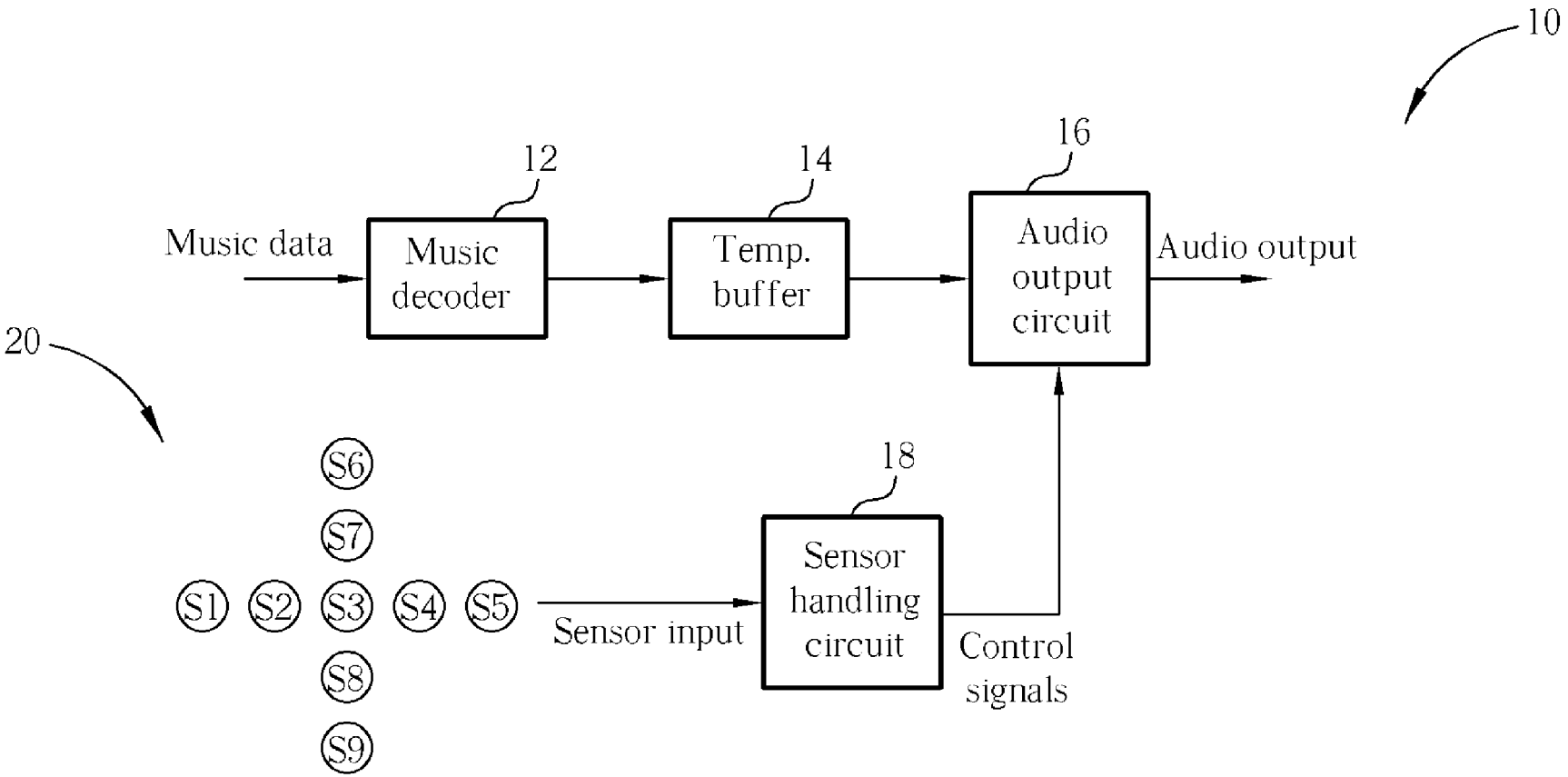
FIG. 1 is a block diagram of a music playback device according to the present invention.

Please refer to FIG. 1. FIG. 1 is a block diagram of a music playback device 10 according to the present invention. A music decoder 12 receives music data, decodes the music data, and stores the decoded music data in a temporary buffer 14. An audio output circuit 16 reads the decoded music data from the temporary buffer 14 and produces audio output. To control music playback, a sensory array 20 is provided having a plurality of sensors S1-S9. A sensor handling circuit 18 receives input from the sensor array 20, converts the input from analog format to digital format, and produces corresponding control signals to be sent to the audio output circuit 16. The control signals control the key in which music is played, the direction in which music played (i.e. either forward or backward), and the playing speed.

Figure 2:
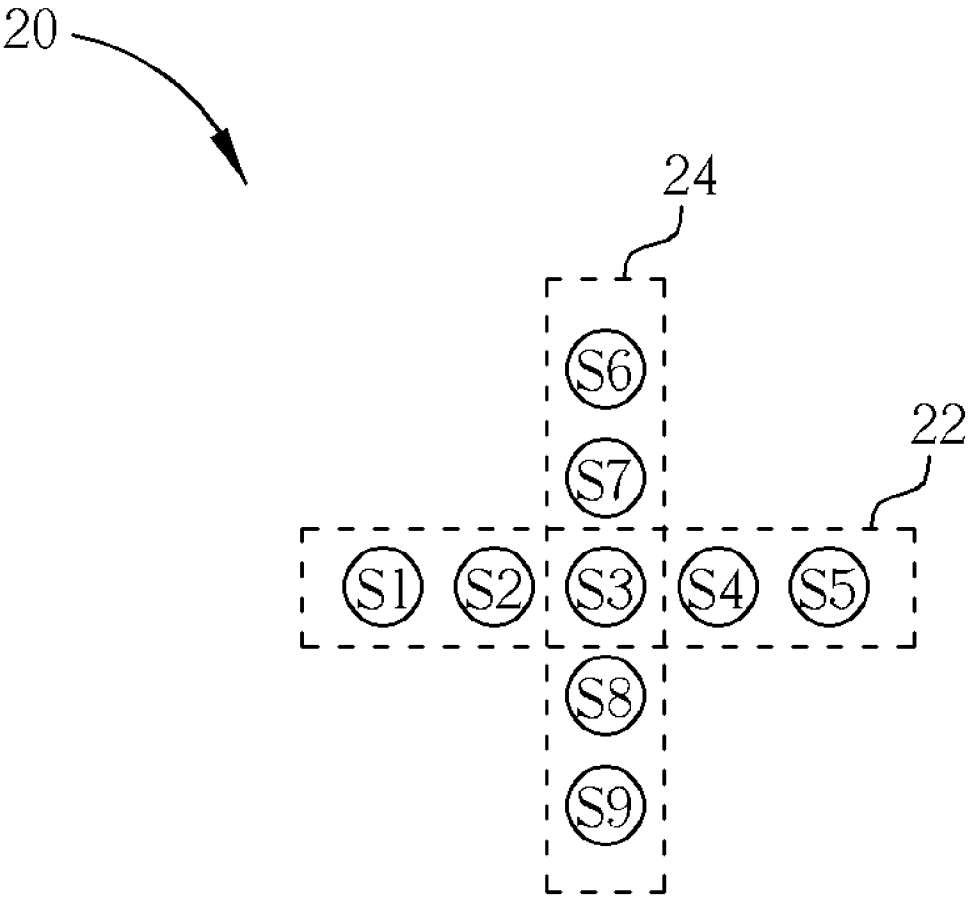
FIG. 2 is a detailed diagram of the sensor array.

Please refer to FIG. 2. FIG. 2 is a detailed diagram of the sensor array 20. The sensor array 20 comprises first sensors 22 shown having a horizontal arrangement and second sensors 24 having a vertical arrangement. The first sensors 22 contain sensors S1-S5, and the second sensors contain sensors S3 and S6-S9. Each of the sensors is activated when the user pushes down on them. Music playback is controlled by analyzing when each sensor S1-S9 is turned on and off. That is, the duration and the sequence in which the sensors S1-S9 are activated determines how music playback will be controlled. Music playback is controlled by activating the first sensors 22 from left to right or from right to left in sequence, or by activating the second sensors 24 from top to bottom or from bottom to top in sequence.

Figure 3:
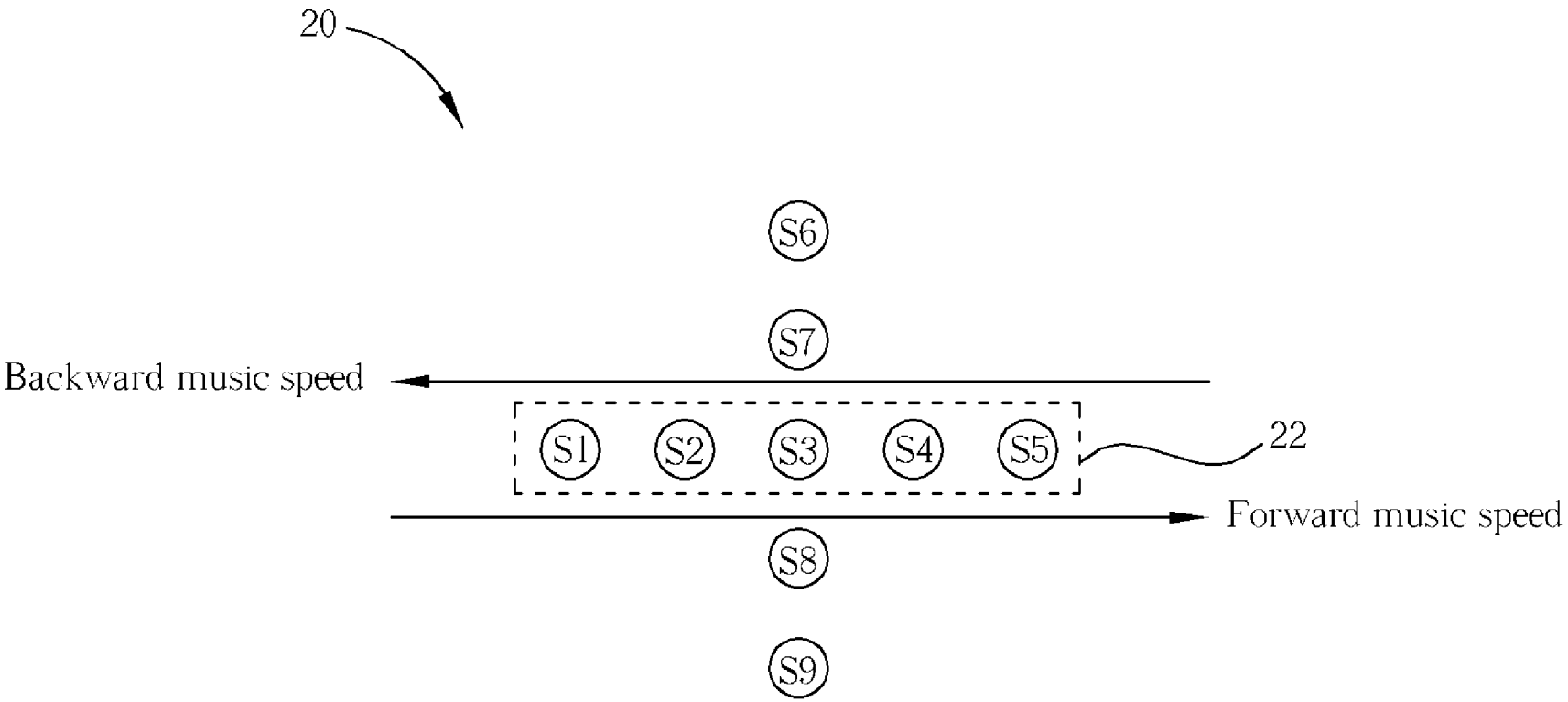
FIG. 3 illustrates controlling the music direction and music speed with the first sensors.

Please refer to FIG. 3. FIG. 3 illustrates controlling the music direction and music speed with the first sensors 22. If the first sensors 22 are activated from left to right, music is controlled to play back in the forward direction, which is the normal direction. If the first sensors 22 are activated from right to left, music is controlled to play back in the backward direction. In addition, playback speed can be controlled for either the forward direction or the backward direction by changing the acceleration used when the user sequentially activates the first sensors 22. A positive acceleration will increase the music speed in either the forward direction or the backward direction, depending on the sequence in which the first sensors 22 are activated. On the other hand, a negative acceleration in either direction will decrease the music speed in that corresponding playback direction.

Figure 4:
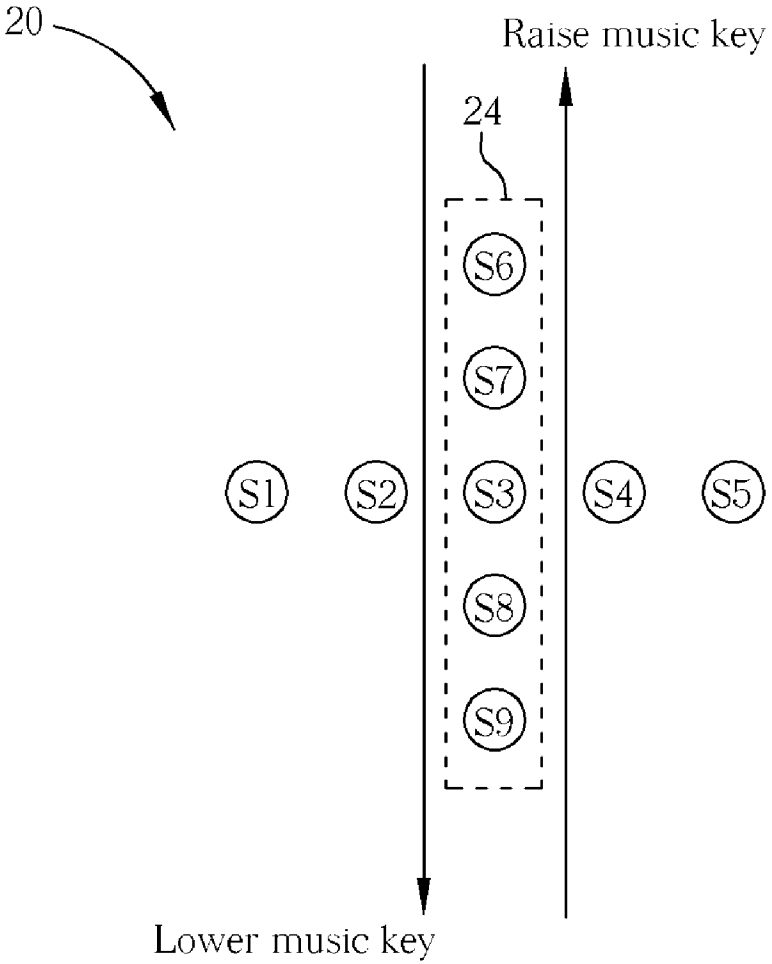
FIG. 4 illustrates controlling the music key with the second sensors.

Please refer to FIG. 4. FIG. 4 illustrates controlling the music key with the second sensors 24. Often times, a user wishes to change the key of a song being played so that the key better matches the user's vocal range. For instance, the key can be changed from C to C# if the key is raised by a half step. If the second sensors 24 are activated from bottom to top, the music key is raised by a predetermined amount. If the second sensors 24 are activated from top to bottom, the music key is lowered by the predetermined amount.

Figure 5:
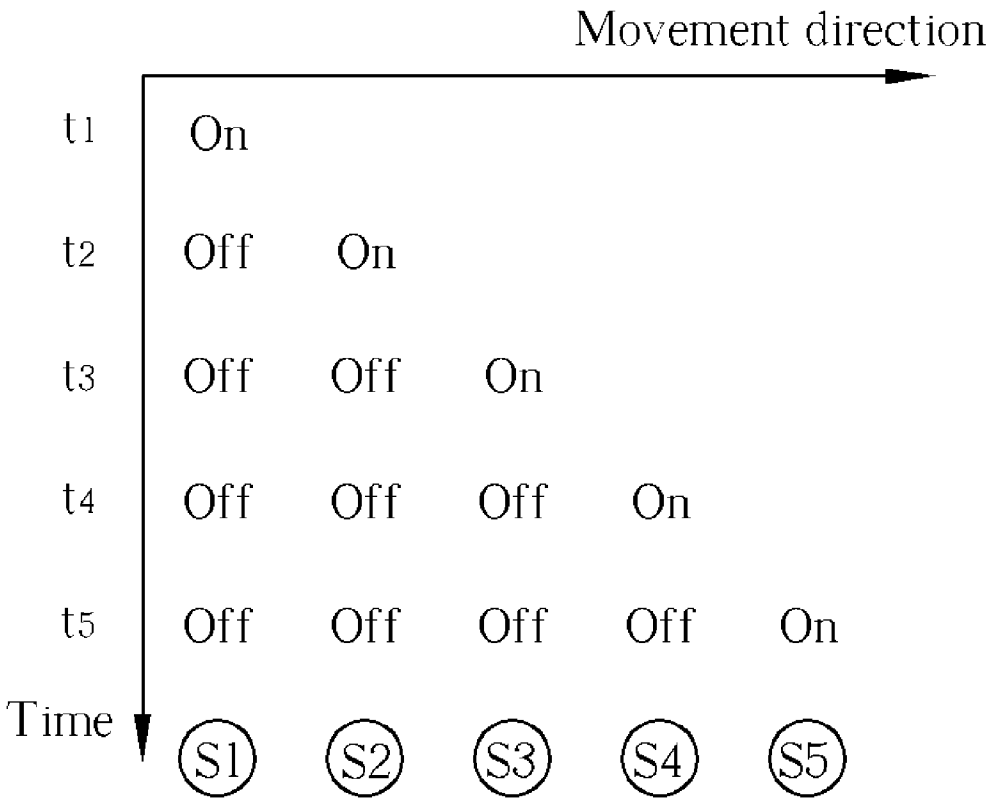
FIG. 5 is a timing illustrating sensor activation timing as sensors are sequentially activated.

Please refer to FIG. 5. FIG. 5 is a timing illustrating sensor activation timing as sensors are sequentially activated. In FIG. 5, the first sensors 22 are activated from left to right, which controls music to be played in the forward direction. Analyzing the timing not only allows the sensor handling circuit 18 to determine which direction the sensors are being sequentially activated in, but it also allows the sensor handling circuit 18 to determine if there is positive or negative acceleration involved. As shown in FIG. 5, sensor S1 is turned on at time $t_1$ and is turned off approximately at the same time that sensor S2 is turned on, which is at time $t_2$. Sensors S3, S4, and S5 are sequentially activated and deactivated at times $t_3$, $t_4$, and $t_5$, respectively.

Figure 6:
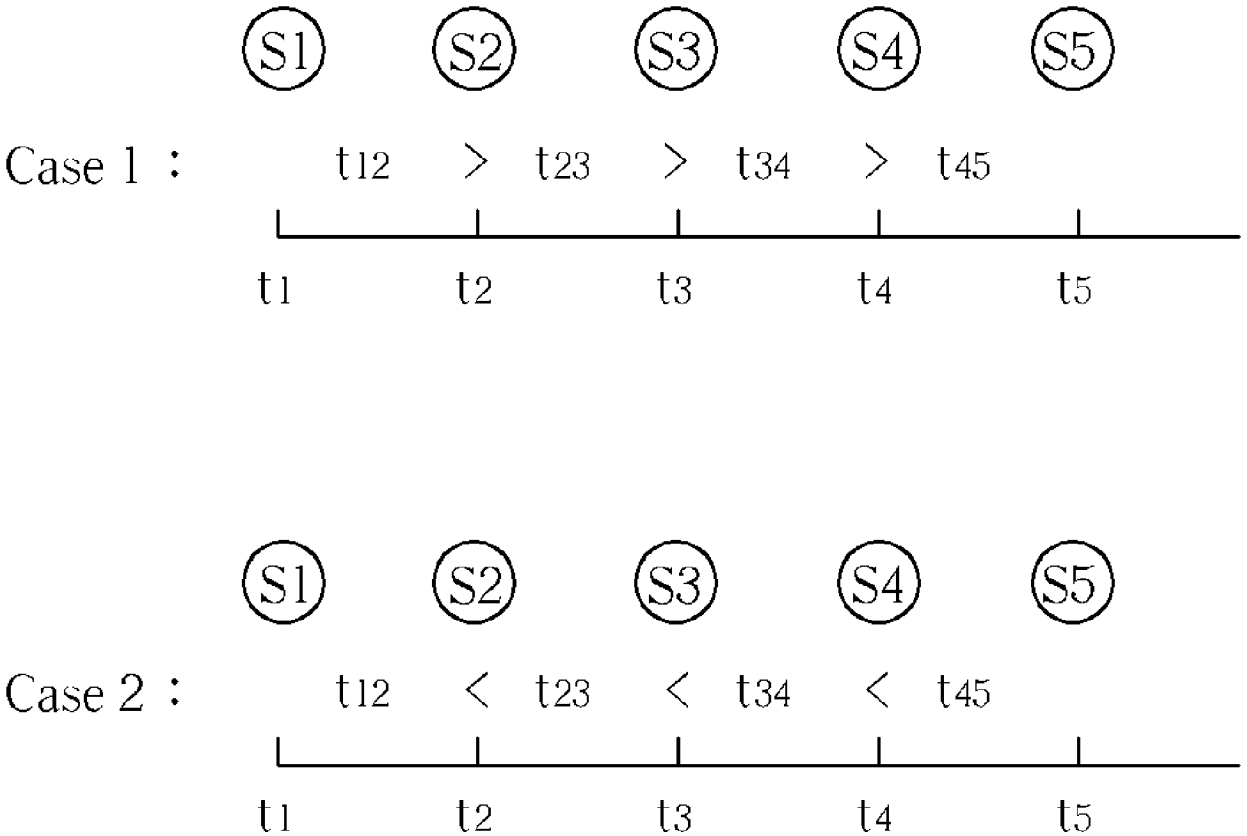
FIG. 6 illustrates using timing information to determine if the first sensors are activated using positive acceleration or negative acceleration.

Please refer to FIG. 6. FIG. 6 illustrates using timing information to determine if the first sensors 22 are activated using positive acceleration or negative acceleration. In Case 1 shown in FIG. 6, sensor S1 was active between times $t_1$ and $t_2$, and the duration is written as $t_{12}$ for shorthand. In Case 1, sensor S1 was active for the longest amount of time, and sensors to the right of sensor S1 were active for increasingly shorter periods of time. Therefore, it can be concluded that the user's finger is positively accelerating as it moves across the sensors S1-S5 from left to right. This positive acceleration from left to right is used to increase the music speed in the forward direction.

In contrast, Case 2 shows a situation in which the user's finger is negatively accelerating as it moves across the sensors S1-S5 from left to right. This is because the time period $t_{12}$ during which sensor S1 is active is shorter than all other time periods, and the time periods get increasingly longer from left to right. This negative acceleration from left to right is used to decrease the music speed in the forward direction.

As an example, Equation 1 below can be used for approximately calculating the acceleration used when activating the first sensors 22 if the first sensors 22 are activated from left to right.

$$\frac{t_{23} - t_{12}}{t_{45} - t_{34}} = \gamma \tag{1}$$

where γ represents an acceleration value. If γ is greater than 1, the acceleration is positive, if γ is less than 1, the acceleration is negative, and if γ is equal to 1, there is zero acceleration. The playback speed can be calculated by multiplying γ by a constant value. For convenience, the playback speed can also be rounded off to the nearest integer, such as 1×, 2×, and so on.

Figure 7:
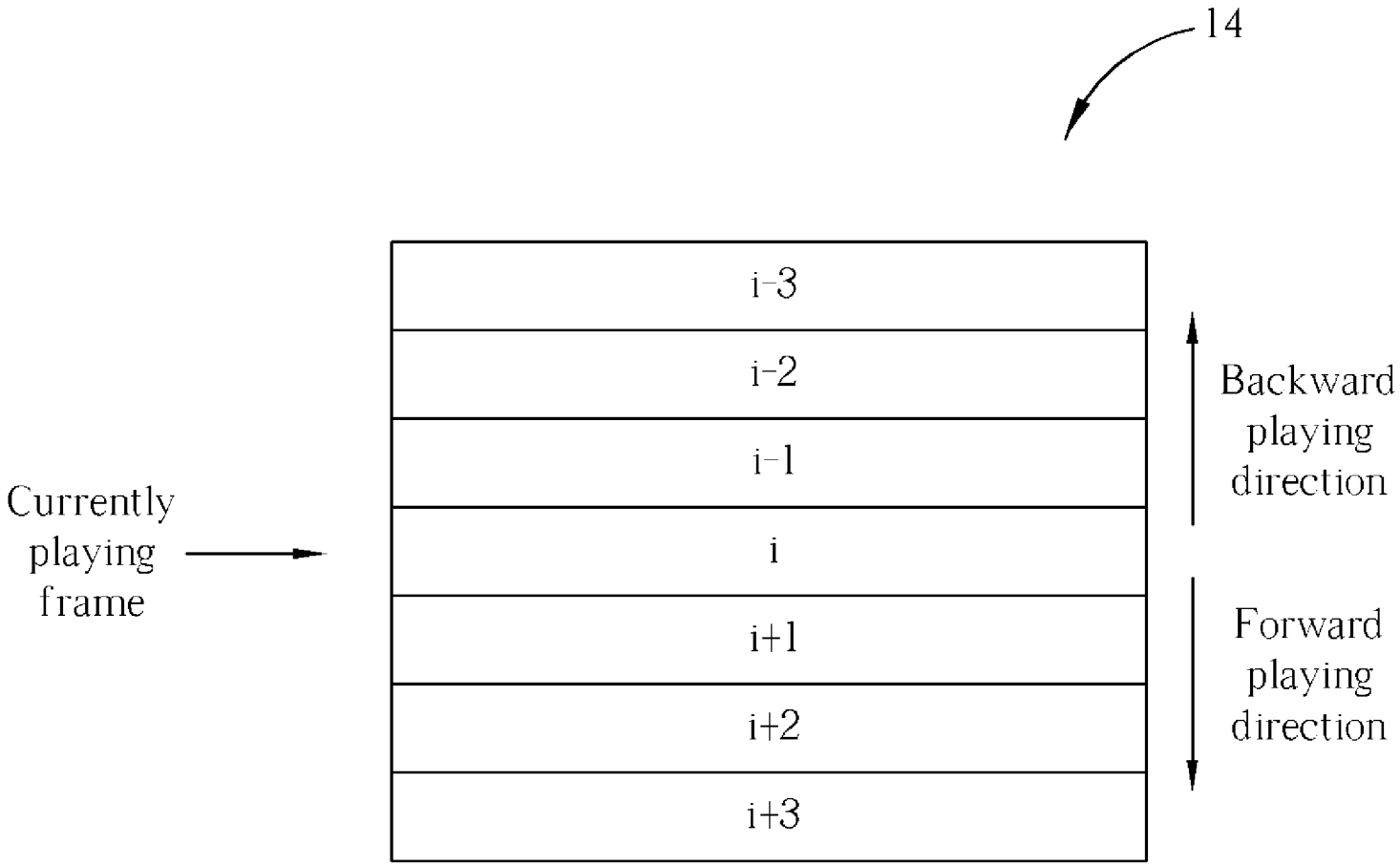
FIG. 7 is a detailed diagram of the temporary buffer.

Please refer to FIG. 7. FIG. 7 is a detailed diagram of the temporary buffer 14. Seven frames are shown in the temporary buffer 14, i−3, i−2, i−1, i, i+1, i+2, and i+3. The frame i represents the frame currently being played. The frame i−1 represents the frame immediately preceding the current frame i and the frame i+1 represents the frame immediately following the current frame i. As shown in FIG. 7, when playing music in the forward direction, the frames are played from the current frame i downward. On the other hand, the frames are played from the current frame i upward when playing music in the backward direction. The music speed also determines how many frames are played per unit time. That is, twice as many frames will be played when the speed is 2× as at a normal playing speed. The temporary buffer 14 should be large enough to handle whatever playing speed and whatever playing direction the user selects using the first sensors 22.

In summary, the sensor array 20 is a tool that allows the user to quickly and intuitively control music playback. The user can easily control the playback direction, the playback speed, and the key of the music being played.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of editing music on a portable device comprising a plurality of keys, the method comprising:

defining the plurality of keys as a sensor array, the sensor array comprising first sensors arranged adjacent to one another;

receiving data output from first sensors of the sensor array;

comparing the time durations in which the first sensors were activated for determining an acceleration used when activating the first sensors along a first direction; and adjusting the music to be played in a first playing direction with a speed relating to the determined acceleration.

2. The method of claim 1, further comprising:

comparing activation times of the first sensors to determine if the first sensors were sequentially activated along the first direction.

3. The method of claim 1 further comprising:

increasing the speed of music to be played in the first playing direction if the first sensors were activated using positive acceleration along the first direction.

4. The method of claim 1 further comprising:

decreasing the speed of music to be played in the first playing direction if the first sensors were activated using negative acceleration along the first direction.

5. The method of claim 1, further comprising:

comparing activation times of the first sensors to determine if the first sensors were sequentially activated along a second direction; and adjusting the music to be played in a second playing direction if the first sensors were sequentially activated along the second direction.

6. The method of claim 5, further comprising:

comparing the time durations in which the first sensors were activated for determining the acceleration used when activating the first sensors along the second direction.

7. The method of claim 6 further comprising:

increasing the speed of music to be played in the second playing direction if the first sensors were activated using positive acceleration along the second direction.

8. The method of claim 6 further comprising:

decreasing the speed of music to be played in the second playing direction if the first sensors were activated using negative acceleration along the second direction.

9. The method of claim 1, further comprising:

comparing the time durations in which the first sensors were activated for determining the acceleration used when activating the first sensors;

increasing the speed of music in a first playing direction if the first sensors were activated using positive acceleration; and decreasing the speed of music in a first playing direction if the first sensors were activated using negative acceleration.

10. The method of claim 1, wherein the sensor array further comprises second sensors arranged adjacent to one another, and the method further comprises adjusting the music being played if the second sensors were sequentially activated along a second direction that is not in parallel with the first direction.

11. The method of claim 1, wherein the first sensors comprise five sensors, and comparing the time durations in which the first sensors were activated for determining an acceleration used when activating the first sensors along a first direction is performed according to the equation $$\frac{t_{23} - t_{12}}{t_{45} - t_{34}} = \gamma,$$

where $\gamma$ represents an acceleration value and $t_{12}$, $t_{23}$, $t_{34}$, and $t_{45}$ respectively represent periods of time that four sequential sensors of the first sensors are activated, in order of the sensor that is first activated to the sensor that is last activated.

12. A music editing device, comprising:

a plurality of keys defined as a sensor array, the sensor array comprising first sensors arranged adjacent to one another;

a sensor handling circuit for receiving data output from first sensors of the sensor array and for comparing the time durations in which the first sensors were activated for determining an acceleration used when activating the first sensors along a first direction;

a temporary buffer for storing frames of music to be played; and an audio output circuit for selectively reading and playing frames of music stored in the temporary buffer with a speed relating to the determined acceleration.

13. The music editing device of claim 12, wherein the sensor handling circuit compares activation times of the first sensors to determine if the first sensors were sequentially activated along the first direction and the audio output circuit adjusts the music to be played in the first playing direction if the first sensors were sequentially activated along the first direction.

14. The music editing device of claim 13, wherein the audio output circuit increases the speed of music to be played in the first playing direction if the first sensors were activated using positive acceleration along the first direction.

15. The music editing device of claim 13, wherein the audio output circuit decreases the speed of music to be played in the first playing direction if the first sensors were activated using negative acceleration along the first direction.

16. The music editing device of claim 12, wherein the sensor handling circuit compares activation times of the first sensors to determine if the first sensors were sequentially activated along a second direction and the audio output circuit adjusts the music to be played in a second playing direction if the first sensors were sequentially activated along the second direction.

17. The music editing device of claim 16, wherein the sensor handling circuit compares the time durations in which the first sensors were activated for determining the acceleration used when activating the first sensors along a second direction.

18. The music editing device of claim 17, wherein the audio output circuit increases the speed of music to be played in the second playing direction if the first sensors were activated using positive acceleration along the second direction.

19. The music editing device of claim 17, wherein the audio output circuit decreases the speed of music to be played in the second playing direction if the first sensors were activated using negative acceleration along the second direction.

20. The music editing device of claim 12, wherein the sensor handling circuit compares the time durations in which the first sensors were activated for determining the acceleration used when activating the first sensors, and the audio output circuit increases the speed of music if the first sensors were activated using positive acceleration and decreases the speed of music if the first sensors were activated using negative acceleration.

21. The music editing device of claim 12, wherein the sensor array further comprises second sensors arranged adjacent to one another, and the audio output circuit adjusts the music being played if the second sensors were sequentially activated along a second direction that is not in parallel with the first direction.

22. The music editing device of claim 12, wherein the first sensors comprise five sensors, and comparing the time durations in which the first sensors were activated for determining an acceleration used when activating the first sensors along a first direction is performed according to the equation $$\frac{t_{23} - t_{12}}{t_{45} - t_{34}} = \gamma,$$

where $\gamma$ represents an acceleration value and $t_{12}$, $t_{23}$, $t_{34}$, and $t_{45}$ respectively represent periods of time that four sequential sensors of the first sensors are activated, in order of the sensor that is first activated to the sensor that is last activated.

* * * * *